US009320338B2

(12) United States Patent
Fischer

(10) Patent No.: US 9,320,338 B2
(45) Date of Patent: Apr. 26, 2016

(54) COSMETIC CONTAINER WITH APPLICATOR AND PIVOTING MECHANISM FOR THE APPLICATOR

(71) Applicant: GEKA GmbH, Bechhofen (DE)

(72) Inventor: Werner Fischer, Burk (DE)

(73) Assignee: GEKA GMBH, Bechhofen (DE)

( * ) Notice: Subject to any disclaimer, the term of this patent is extended or adjusted under 35 U.S.C. 154(b) by 735 days.

(21) Appl. No.: 13/656,432

(22) Filed: Oct. 19, 2012

(65) Prior Publication Data

US 2013/0108354 A1 May 2, 2013

(30) Foreign Application Priority Data

Oct. 19, 2011 (DE) ..... 20 2011 051 677 U

(51) Int. Cl.

| | |
|---|---|
| ***A45D 40/26*** | (2006.01) |
| ***A45D 19/02*** | (2006.01) |
| *A45D 40/00* | (2006.01) |
| *A45F 5/00* | (2006.01) |

(52) U.S. Cl.

CPC ..... *A45D 40/264* (2013.01); *A45D 19/02* (2013.01); *A45D 40/265* (2013.01); *A45D 2040/0012* (2013.01); *A45F 5/00* (2013.01)

(58) Field of Classification Search

CPC . A45D 40/262; A45D 40/264; A45D 40/265; A46B 11/0072; A46B 11/0079; A46B 11/0086; A46B 11/0089; A46B 2200/1046; A46B 2200/1053

USPC ..... 15/244.2; 401/117, 269

See application file for complete search history.

(56) References Cited

U.S. PATENT DOCUMENTS

| | | | | |
|---|---|---|---|---|
| 4,428,388 | A * | 1/1984 | Cassai | A46B 9/021 132/218 |
| 5,328,282 | A | 7/1994 | Charrier et al. | |
| 5,332,325 | A * | 7/1994 | Crosnier | A45D 34/046 401/119 |
| 5,382,107 | A * | 1/1995 | Nian | A46B 5/0033 15/185 |
| 5,476,333 | A * | 12/1995 | Matthews | A46B 5/0033 401/132 |
| 6,158,913 | A * | 12/2000 | Dumler | A45D 34/043 401/107 |
| 6,371,129 | B1 * | 4/2002 | Le Bras-Brown | A45D 34/043 132/218 |
| 6,718,990 | B1 * | 4/2004 | Chastain | A45D 40/026 132/218 |
| 6,991,396 | B2 * | 1/2006 | Gueret | B65D 47/42 132/320 |
| 7,048,460 | B1 * | 5/2006 | Thompson | A45D 44/18 401/123 |

(Continued)

FOREIGN PATENT DOCUMENTS

| | | |
|---|---|---|
| DE | 19832403 A1 | 1/2000 |
| EP | 1247472 A1 | 10/2002 |

(Continued)

*Primary Examiner* — Jennifer C Chiang
*Assistant Examiner* — Bradley Oliver

(57) ABSTRACT

The invention relates to a cosmetic container for a liquid or paste-like cosmetic product or the like, having a reservoir for the cosmetic product and having an applicator for applying the cosmetic product to the skin and/or hair. The applicator is supported on the cosmetic container in pivoting fashion and, by pivoting around a pivoting axis, can be pivoted between an idle position inside the reservoir and at least one use position outside the reservoir.

13 Claims, 10 Drawing Sheets

(56) References Cited

U.S. PATENT DOCUMENTS

| | | | | |
|---|---|---|---|---|
| 8,292,529 | B2 * | 10/2012 | Francavilla | A45D 34/043 401/101 |
| 2004/0009028 | A1 * | 1/2004 | Gueret | A45D 40/265 401/129 |
| 2004/0184865 | A1 * | 9/2004 | Carroll | A45D 40/20 401/107 |
| 2010/0236567 | A1 * | 9/2010 | Carroll | A45D 40/264 132/200 |
| 2010/0300476 | A1 * | 12/2010 | Bennett | A45D 40/18 132/218 |
| 2011/0108046 | A1 | 5/2011 | Horton | |
| 2011/0110701 | A1 * | 5/2011 | Gueret | A45D 40/265 401/126 |
| 2013/0315646 | A1 * | 11/2013 | Stredak | A45D 40/262 401/118 |

FOREIGN PATENT DOCUMENTS

| | | | |
|---|---|---|---|
| EP | 1570763 | A1 | 9/2005 |
| WO | 2004077987 | A1 | 9/2004 |

* cited by examiner

COSMETIC CONTAINER WITH APPLICATOR AND PIVOTING MECHANISM FOR THE APPLICATOR

FIELD OF THE INVENTION

The invention relates to a cosmetic container for a liquid or paste-like cosmetic product; this cosmetic container has a reservoir for the cosmetic product and an applicator for applying the cosmetic product.

BACKGROUND OF THE INVENTION

The cosmetic product is preferably a mascara compound. Alternatively, however, it can for example also be a hair coloring product (e.g. for coloring highlights) or the like. The user can withdraw cosmetic product contained in the reservoir through a withdrawal opening by means of the applicator and apply it to skin, hair, and in particular, eyelashes.

In the cosmetic containers known from the prior art, the withdrawal opening can be closed by means of a sealing cap belonging to the cosmetic container, with the applicator typically being fastened to this sealing cap. During application, the user must guide the applicator with one hand while holding the cosmetic container with the other hand.

The object of the invention is to create an easy-to-use cosmetic container of the type mentioned at the beginning.

SUMMARY OF THE INVENTION

The proposed cosmetic container includes a reservoir for storing the cosmetic product and an applicator for applying the cosmetic product to skin, hair, and in particular, eyelashes. According to the invention, the applicator is mounted to and supported in the cosmetic container in pivoting fashion and essentially, and preferably exclusively, can be moved back and forth around a pivot axis between an idle position inside the reservoir and at least one use position outside the reservoir.

In the idle position, the applicator is situated inside the reservoir. In the use position, the applicator is situated outside the reservoir and is freely accessible so that it can be brought into contact with the part to be treated. The invention provides a pivoting mechanism for the applicator, which allows the applicator to be reversibly pivoted between its idle position and at least one use position. The applicator remains attached to the cosmetic container even in the use position. Unlike with previously known cosmetic containers, it is therefore not necessary to completely detach the applicator from the reservoir in order to use it to apply the product. For this reason, the cosmetic container according to the invention is particularly easy to use.

Preferably, the applicator is arc-shaped or banana-shaped and is embodied with an essentially or even absolutely constant radius relative to the pivot axis and can therefore be pivoted in and out through a withdrawal opening of the reservoir.

Also preferably, a sealing element is provided in the withdrawal opening of the reservoir. When the container is closed, the purpose of this sealing element is to prevent the cosmetic product from flowing past the stripper to the outside in an uncontrolled fashion. The sealing element can be an integral component of a stripper or can be embodied in the form of an additional, separate seal, preferably in the form of a flat seal.

The pivoting angle for the applicator is preferably between 50° and 150°, better still between 60° and 135°, and ideally between 70° and 120°.

Preferably, at least one stop element is provided to limit the pivoting motion, particularly when pivoting the applicator into the use position.

In preferred exemplary embodiments, means are provided, in particular detent engagement means, in order to temporarily immobilize the applicator in the closed position and/or in the use position. A detent engagement means that immobilizes the applicator in its closed position is preferably designed in such a way and preferably cooperates with a housing part and the actuating grip in such a way that the actuating grip presses with the required prestressing force against a seal preferably secured in a housing part, thus lastingly preventing escape of the cosmetic product.

The cosmetic container according to the invention can be embodied as a small, flat, and round or in the form of a small, flat, and round capsule, as explained in greater detail below.

The large end surfaces or main surfaces of this capsule are preferably provided with concave recesses, for example to facilitate handling.

The cosmetic container or capsule preferably has a housing part and an actuating grip supported on this housing part in pivoting fashion. In this case, the applicator is affixed to the pivoting actuating grip and consequently follows its pivoting movements in an unrestricted fashion. When pivoted from a closed position into an open position, the actuating grip, which is supported in pivoting fashion, can unblock a part of the capsule embodied in the form of cut-out shaped like a sector of a circle or an opening shaped like a slice of pie; at the same time, the applicator is pivoted out of its idle position into its use position inside this cut-out or opening and vice versa when it is closed again.

Preferably, as it is pivoted from its closed position into its open position, the pivotably supported actuating grip can also travel into a recess or cavity on the inside of the cosmetic container or capsule.

Other features, advantages, and possible embodiments of the invention ensue from the following description of several exemplary embodiments in conjunction with the drawings.

BRIEF DESCRIPTION OF THE DRAWINGS

FIG. 2A shows a side view, FIG. 2B shows a front view, and FIG. 2C shows an opposite side view.

FIG. 3A shows a front view, FIG. 3B shows a side view, FIG. 3C shows the cosmetic container at an oblique angle from the front, and FIG. 3D shows the cosmetic container at another oblique angle from the front.

in FIG. 4A, the applicator is in the idle position and in FIG. 4B, the applicator is in the use position.

FIG. 7A shows a front view with the applicator in the idle position, FIG. 7B shows a top view with the applicator in the idle position, FIG. 7C shows a front view with the applicator in the use position, and FIG. 7D shows a top view with the applicator in the use position.

DETAILED DESCRIPTION OF THE PREFERRED EMBODIMENTS

Figure 1:
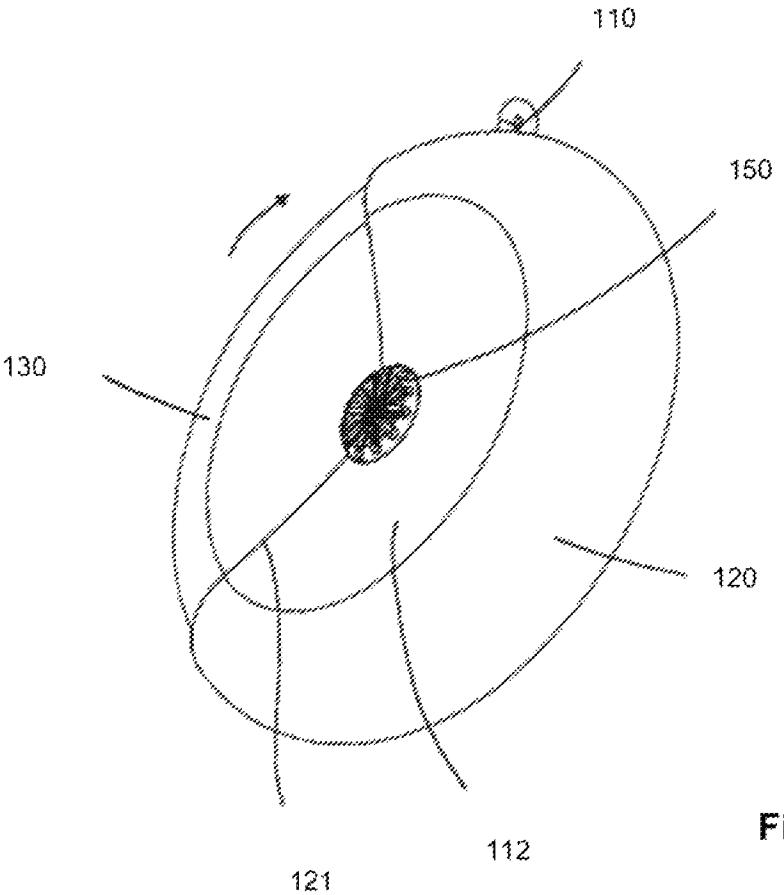
FIG. 1 shows a first exemplary embodiment of a cosmetic container with the applicator in the idle position.

FIG. 1 shows a cosmetic container 100, which is embodied in the form of a small, flat, and completely or at least essentially round capsule.

Figures 2A, 2B, 2C:
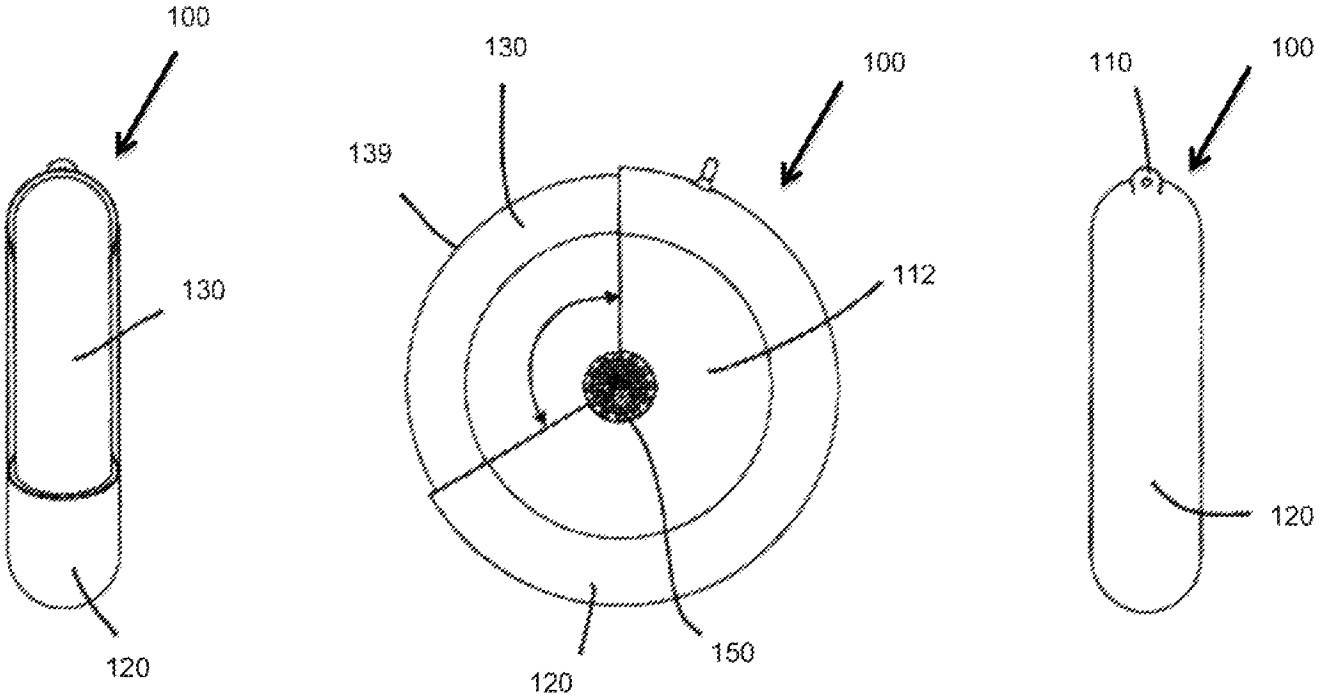
FIGS. 2A-2C show several individual views of the cosmetic container from FIG. 1. In particular.

The term "round" is understood to mean that the cosmetic container 100 has a circular outline when viewed from above (see FIG. 2B). Alternatively, the cosmetic container can also have an outline that is approximately round and can, for example, be octagonal, ten-sided, or the like. In individual cases, a hexagonal embodiment is also conceivable.

The term "flat" is understood to mean that the diameter perpendicular to the pivot axis or pivot joint 126 is a multiple of the height at the thickest point. Preferably, the diameter is at least 3 times and better still, at least 5 times the height at the thickest point.

The cosmetic container 100 is rounded at its outer circumference between the opposing end surfaces, thus producing approximately the shape of a discus. The shape, which is reminiscent of a pocket watch, has no edges or corners and therefore fits into the hand extremely well. Preferably, the outer contour of the cosmetic container that is rounded over its entire circumference fits comfortably in the hand and therefore is pleasing to hold, which on an unconscious level, also improves the readiness to accept the unconventional type of application that the invention involves.

In addition, the cosmetic container 100 is embodied with concave recesses 112 on two opposing end surfaces, which serve as recessed grips and facilitate handling. These recessed grips, which also lend the cosmetic container a certain lightness in look, increase the level of acceptance in users since the recessed grips—without significantly reducing the amount of space available for storage of the cosmetic product—contribute to counteracting the impression of the container being a solid, chunky container that is too massive to permit a sensitive application of mascara or other cosmetic product. Such a concave recess or recessed grip 112 preferably occupies at least 30% and more preferably at least 50% of the area of an end surface. The deepest point of the concave recesses 112 is situated in the center of the area or the center point of the circle of the end surfaces. The height or thickness of the cosmetic container 100 is therefore significantly smaller in the middle than it is toward the outside, preferably by up to 30% and ideally by up to 50%. Preferably, the concave recesses 112 on the two end surfaces are embodied symmetrically. The concave surface portions 112 on both end surfaces produce an overall impression similar to that of a wheel or tire.

The cosmetic container 100 includes a housing or housing part 120 whose interior accommodates a reservoir for storing a cosmetic product or the like, as will be explained in greater detail below. The reference numeral 110 indicates an eyelet on the outer surface of the housing 120 through which a cord, a chain, or the like can be threaded or hooked; this eyelet 110 can also serve as a handling aid, e.g. when equipped with a corresponding cord, and the cosmetic container is very dainty. Instead of such an eyelet 110 or in addition to it, it is also possible to provide a grip or the like.

The housing 120 has an opening 121 that is embodied in the form of cut-out shaped like a sector of a circle or a slice of pie. In the depictions shown in FIGS. 1 and 2, this opening is closed, as will be explained in greater detail below. The opening angle or central angle $\alpha$ of the opening 121 shown in particular in FIG. 2B is preferably in the range from 40° to 190° and better still in the range from 80° to 150°. In the exemplary embodiment shown, the opening angle $\alpha$ is approximately 120°.

The cosmetic container 100 also includes an applicator part that has a pivotable actuating grip 130 and fastened to this pivotable actuating grip 130, an applicator element 135 for applying the cosmetic product stored in the reservoir, also see FIG. 3. In the depictions shown in FIGS. 1 and 2, the opening 121 in the housing 120 is closed by the actuating grip 130. In order to open or unblock the opening 121, a manual force can be exerted so as to pivot the actuating grip 130 out of the closed position shown, which is indicated with an arrow in FIG. 1. In the course of this, the actuating grip 130 slides into the housing 120 and simultaneously, the applicator 135 is pivoted into its use position (application-ready position) inside the opening 121. FIG. 3 shows the cosmetic container 100 with an unblocked opening 121; the applicator 135 is in its use position inside this opening 121.

Figure 4B:
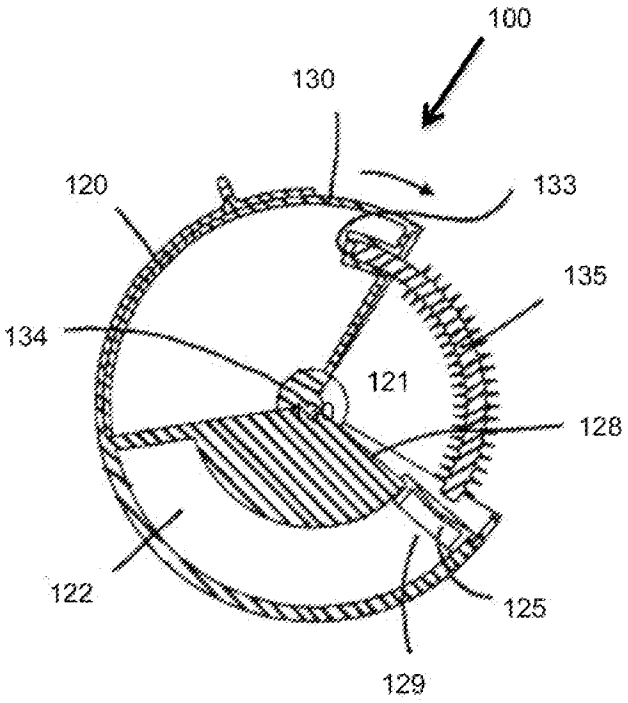
FIGS. 4A and 4B show two individual depictions of a section through the cosmetic container from FIG. 1.
Figure 4A:
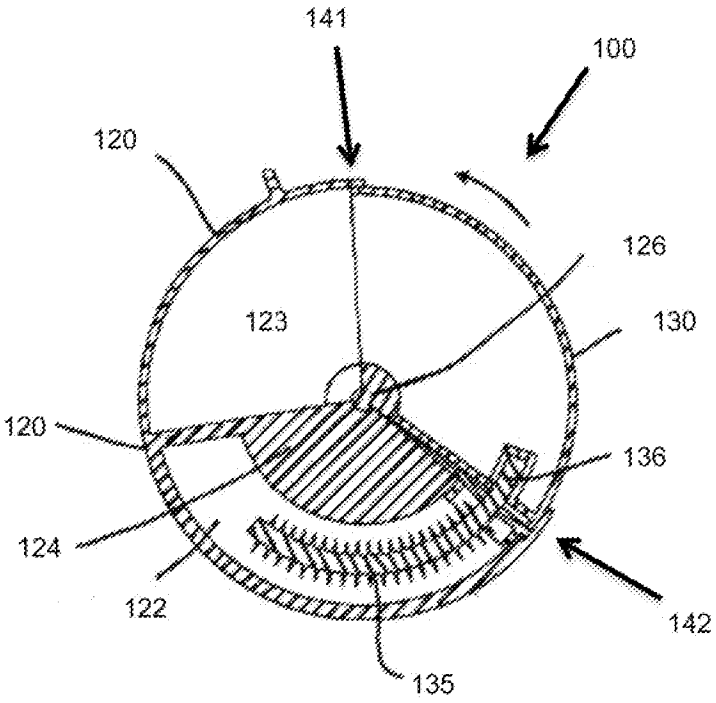

FIG. 4A shows a section through the cosmetic container 100; the circular sector-shaped opening 121 in the housing 120 is closed by the actuating grip 130 that is part of the applicator part, as explained above. This sectional depiction shows the reservoir 122 that is accommodated inside the housing 120 and defines a reservoir preferably embodied in the form of a curved, hollow cylinder, in which a cosmetic product is stored, which is preferably a mascara compound. The reservoir 122 has a withdrawal opening 129 in which a sealing element and/or stripper element 125 is provided.

Without limiting the scope of protection, the rheology of the cosmetic product according to the invention may be adjusted so that the cosmetic product is on the one hand viscous enough that it does not prematurely escape from the reservoir by itself when the cosmetic container is held in the position shown in FIG. 4B and guided to the eye, namely in a position in which the axis D at least essentially corresponds to the vertical direction. In a suitable way, the cosmetic product is adjusted for example so that the cosmetic container can be kept stationary in the position shown in FIG. 4B for at least three minutes at 23° C. without the cosmetic product being able to escape by itself through the open stripper opening or withdrawal opening 129. On the other hand, the cosmetic product must have a sufficient degree of "creeping ability" in order to sufficiently wet the applicator even during storage of the cosmetic container for several hours (preferably 3 h) between two uses when the reservoir contains only part of the cosmetic compound with which it was originally filled. This is specifically important in such a system according to the invention because in this case, the applicator is guided in captive fashion and therefore it is not possible for the user "to poke" the applicator into the already partially emptied reservoir in order to load the set of applicator bristles with viscous cosmetic product that is sticking to the walls of the reservoir.

The applicator 135 for applying a cosmetic product is situated inside the reservoir 122.

The applicator 135 is affixed to the actuating grip 130.

The sectional depiction in FIGS. 4A and 4B also clearly shows the division of the housing 120 into three regions or sectors that are preferably the same size. The first sector contains the receiving opening 121 that is closed as needed by the actuating grip 130. The second sector contains the reservoir 122. The third sector contains a chamber or cavity 123 that is provided to accommodate preferably almost all or most of the actuating grip 130, but sometimes only part of it, as explained in greater detail below.

In the position shown in FIG. 4A, the applicator 135 is situated inside the reservoir 122. This is the idle position or stowed position of the applicator 135, with the cosmetic container 100 as a whole in a storage and/or transport position. The applicator 135 can load up with the cosmetic product contained inside. In order to move the applicator 135 from the depicted idle position inside the reservoir 122 into a use position, the actuating grip 130 that is supported in pivoting or rotary fashion on the pivot joint or swivel 126 is pivoted in the direction indicated with the arrow through manual exertion of a force or torque. This causes the actuating grip 130 to travel into the cavity 123, which corresponds to a pivoting from the first sector into the third sector. At the same time, the applicator 135 is pulled out through the withdrawal opening 129 in the course of which, excess cosmetic compound adhering to it is stripped off at the stripper element 125 so that the excess compound remains inside the reservoir 122.

The applicator 135 that has been pulled out of the reservoir 122 by a pivoting motion finally travels into the cut-out 121 shaped like a slice of pie or cake in the housing 120 and is then in a use position. The cosmetic container 100 as a whole is therefore ready for use. This is shown in FIG. 4B.

The opening pivoting action of the actuating grip 130 from its closed position—in which it occupies the opening 121—into the open position—in which it is inside the cavity 123—is limited by stops on the radial wall 127 of the housing 120. It is also possible for the actuating grip 130, preferably in the vicinity of the pivot joint 126, to have a stop cam or the like in order to limit the pivoting movement relative to the housing part 120 in the opening direction. Furthermore, in most cases, detent engagement means that are not shown in detail are provided, which temporarily hold or immobilize the actuating grip 130 in this position (open position). This has the great advantage that the user can easily hold the cosmetic container by the housing 120 and guide it to the part to be treated, without having to actively ensure that the actuating grip that in turn holds the applicator does not shift in relation to the housing 120.

So that during the pivoting (from the closed position shown in FIG. 4A into the open position shown in FIG. 4B), the actuating grip 130 of the applicator part is able to travel into the cavity 123 in the housing or capsule 120, the shape of this actuating grip 130 is embodied to correspond to the inner shape of the cavity 123 so as to enable it to pivot or slide into place. This is clearly shown in FIGS. 3C and 3D. In this case, the inner surface or inner wall of the cavity 123 can constitute a guide for the actuating grip 130 so that the pivot joint 126 can be embodied in a relatively simple manner or can be entirely eliminated because the inner surface of the cavity 123 or a defined part of this inner surface takes on the entire task of guiding the actuating grip in captive fashion along a circular path. This is particularly possible if the capsule has a recess in the central region of its large end surfaces, which in the exemplary embodiment are each composed of the concave recess.

The actuating grip 130 is embodied in the form of a hollow piece whose side oriented toward the applicator has an opening of the kind that is suitable in order to allow such a part to be removed from an injection molding mold. Preferably, the actuating grip 130 is integrally embodied of one piece. In particular, the actuating grip 130 is an injection molded piece composed of a plastic or aluminum material. As depicted very clearly in FIG. 4A, the grip 130 and housing 120 are dimensioned and fixed relative to each other so that even after reaching its closed position, the grip 130 still protrudes a certain distance into the cavity of the housing 120 so that its unattractive rear opening remains hidden from the user.

Figure 3C:
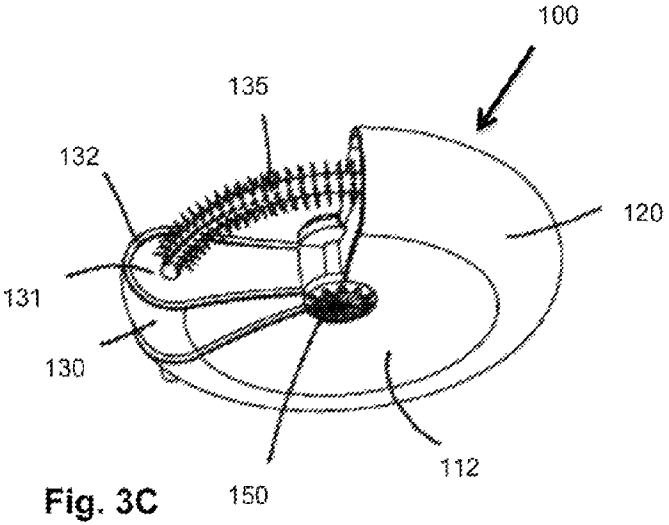
FIGS. 3A-3D show several individual views of the cosmetic container from FIG. 1, with the applicator in the use position. In particular.

In FIG. 3C, the preferably drop-shaped embodiment of the front wall or end wall 131 of the actuating grip 130 is very clearly visible, with a cross section that widens out from the inside to the outside in order to thus achieve an adaptation of the shape to the concave recesses 112 in the end surface of the cosmetic container 100 housing 120. Furthermore, the actuating grip 130 is embodied with an arc-shaped outer contour or outline 139 at its circumference oriented away from the pivot joint 126; preferably, this is a circular arc whose center point coincides with the pivot joint 126 or pivot axis. When the actuating grip 130 is in the closed position (see FIG. 2B), the arc in the opening 121 takes the place of the circular circumference line of the housing 120. The actuating grip 130 is also shaped like a sector of a circle or a slice of pie; the opening angle or central angle is greater (e.g. by 5° to) 10° than the angle $\alpha$ of the opening 121 in the housing 120 so that there is always an overlap between the housing 120 and the actuating grip 130, as explained in greater detail below.

Figure 3D:
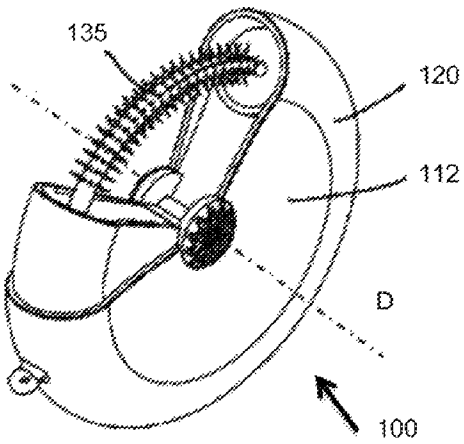
Figure 3A:
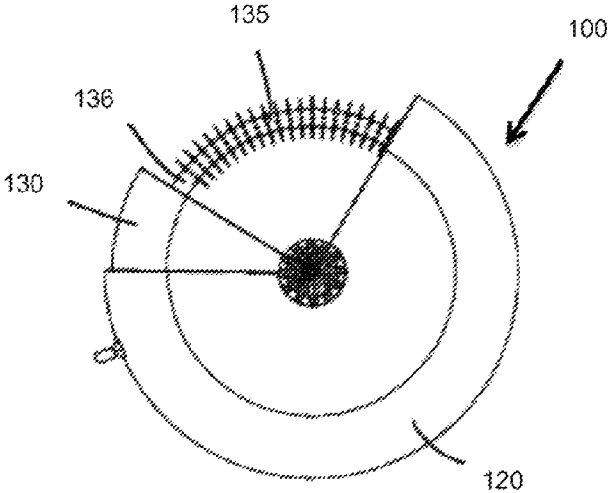
Figure 3B:
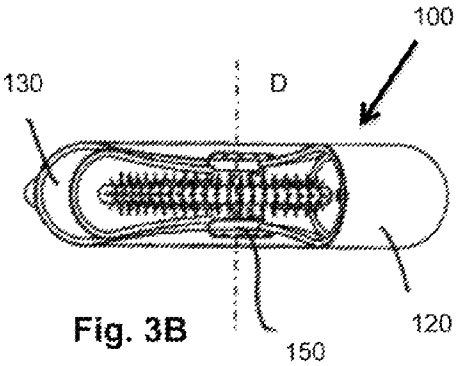

The pivot joint 126, if provided, is composed of a shaft 134 embodied on the actuating grip 130 and a bearing shell for this shaft 134, embodied on the housing 120. Because of the guidance of the actuating grip 130 along a large area of the inner wall of the cavity 123, the pivot joint 126 can have a relatively simple embodiment and small dimensions. The pivoting axis D extending through the center point of the end surfaces is shown in FIGS. 3B and 3D. In the region of the pivot joint 126, the housing 120 is reinforced by a solid region 124 (see FIG. 4A). Alternatively, a ribbing can also be provided in this region. Preferably, the housing 120 is integrally embodied of one piece composed of a plastic material or if need be also a metal material such as aluminum; the housing parts can be composed of the same material or of different materials. Preferably, the housing 120, at least in the visible sections, has a rugged surface which at the same time has a high-quality appearance; the same is also true for the actuating grip 130.

In order to pivot or move the actuating grip 130 out of the open position shown in FIG. 4B into the closed position shown in FIG. 4A, it is pivoted in the direction indicated by the arrow (see FIG. 4B) through manual exertion of a force or torque. In order to be able to do this as simply as possible, when the actuating grip 130 is in the open position, it protrudes slightly into the opening 121. When the actuating grip 130 is pivoted, this simultaneously pivots the applicator 135 out of the use position in the opening 121, as shown in FIG. 4B, into the idle position inside the reservoir 122, as shown in FIG. 4A, where it can once again load up with cosmetic product. The closing movement ends when the front end wall 131 or the circumferential edge 132 (see FIG. 3C) comes into contact with the radial wall 128 of the housing 120. Detent engagement means that are not shown in detail can be provided, which temporarily immobilize the actuating grip 130 in its closed position. If the actuating grip 130 is in the closed position shown in FIG. 4A, then it is overlapped by the housing 120 at both ends. The overlap regions are labeled with the reference numerals 141 and 142. The actuating grip 130 can be prestressed by a spring element so that it is prestressed into its closed position relative to the housing part 120, i.e. has a tendency to be pressed into the closed position. The spring element can be accommodated, for example, in the cavity 123.

By reversibly pivoting the actuating grip 130, the applicator 135 can be pivoted between an idle position inside the reservoir 122 and a use position outside the reservoir 122, namely within the opening 121. It is not necessary to separate the applicator 135 from the housing 120 in order to move the applicator 13 5 into the use position in which the cosmetic product adhering to it can be applied to the skin and/or hair, which makes the cosmetic container 100 particularly easy to handle. The actuating grip 130 can be provided with a corrugation or knurling to facilitate handling and the pivoting action in particular. Each time it is dipped into the reservoir 122, the applicator 135 can load up with cosmetic product; when it is pulled back out again, excess cosmetic product is stripped off again at the sealing element and/or stripper element 125. The sealing element and/or stripper element 125 seals the reservoir 122 against the applicator 135 or more precisely against the applicator support pin 136, when the applicator 135 is in its idle position inside the reservoir 122, for example in that the stripper lips rest against the applicator support pin 136 in a sealed fashion and thus seal the withdrawal opening 129, preventing the unwanted escape of the cosmetic product. In addition, the sealing element and/or stripper element 125 can be embodied so that the withdrawal opening 129 is sealed after the applicator 135 is pulled out. Preferably, the sealing element and/or stripper element 125 is composed of a soft elastic material. In order to seal the withdrawal opening 129, a sealing ring can additionally or alternatively be provided on the applicator 135 or more precisely on the applicator support pin 136.

The applicator 135 is embodied as a small brush and the bristles or fingers of this small brush are situated on an applicator support pin (core) 136. Preferably, an integral, one-piece embodiment of the fingers and applicator support pin 136 is provided. The applicator 135 can, for example, be a multi-component injection molded part. The applicator 135 can also be a small sponge or the like. The applicator 135 is attached in a recess 133 of the end wall 131 of the actuating grip 130 by means of the applicator support pin 136 (see FIG. 4B), so that the applicator 135 necessarily follows the pivoting movements of the actuating grip 130. The applicator 135 is curved or banana-shaped. The curvature corresponds to an arc with a constant radius (circular arc) around the pivot joint 126 or the rotation axis D. The interior of the reservoir 122 also has a curved shape. For example, it is embodied in the shape of a curved cylinder that is situated in the outer region and in particular, completely within a region that extends from the maximum radius (outer radius) of the cosmetic container 100 perpendicular to the rotation axis D and a radius that at a minimum, corresponds to half of the above-mentioned maximum radius. Preferably, the curved applicator 135 and the curved interior of the reservoir 122 match each other in shape and dimensions in order to permit the applicator 135 to pivot in and out in an optimum way and also to ensure a favorable wetting of the applicator 135 with the cosmetic product.

The cosmetic container 100 has a locking mechanism for locking the actuating grip 130 in its closed position and/or in its open position and for preventing the actuating grip 130 from inadvertently coming out of its closed position. The locking mechanism can be unlocked by means of a centrally located push button 150. Through the concave recesses 112 on the end surfaces, the push button 150 is in a protected position (for example, see FIG. 3B). A simple locking mechanism will be explained below in conjunction with FIG. 5.

Figure 5:
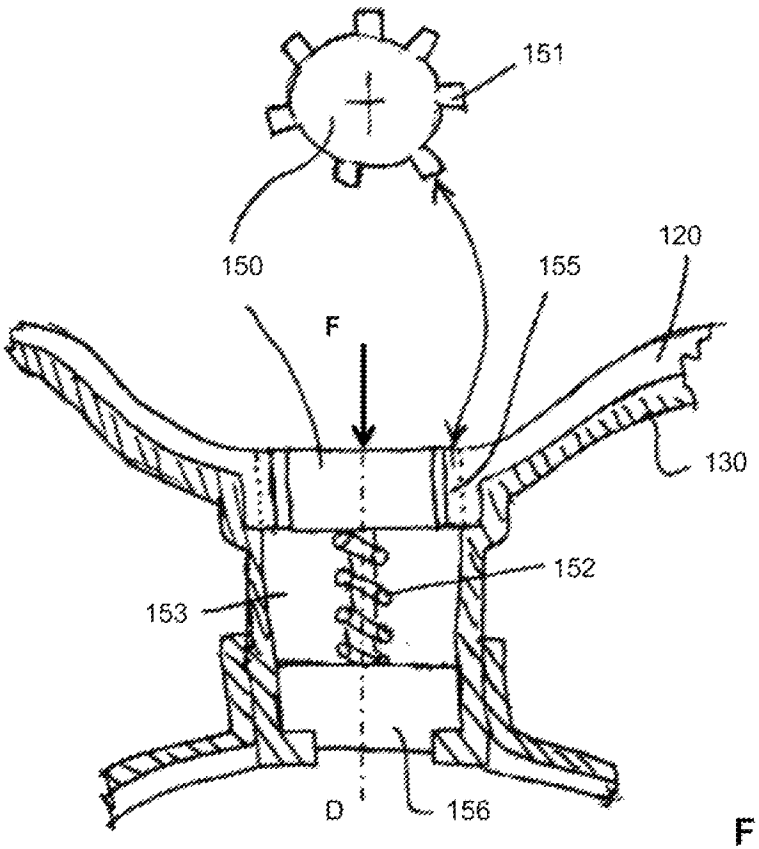
FIG. 5 shows a locking mechanism for the cosmetic container from FIG. 1.

FIG. 5 shows a section through the centrally located locking mechanism. The locking mechanism is only schematically depicted. The locking mechanism includes a resiliently prestressed cylindrical push button 150, which is provided with protruding cams 151 on its outer circumference, as illustrated by the upper part of the figure, which shows a top view of the push button 150. The cams 151 on the outer circumference of the push button 150 can engage in corresponding grooves 155 on the housing 120, thus producing the locking action between the actuating grip 130 and the housing 120. In order to release this locking action, a compressive force F must be exerted on the push button 150 in opposition to the spring 152, permitting the push button 150 to deflect into the bore 153 and releasing the engagement of the cams 151 in the grooves 155 on the housing 120. As a result, it is possible for the actuating grip 130 to pivot or rotate relative to the housing 120. The spring 152, which is supported against the stationary pressing element 156, automatically returns the push button 150 to the position shown. The cams 151 on the push button 150 and the corresponding grooves 155 on the housing 120 enable a plurality of locking and immobilizing positions. In other words, the actuating grip 130 can preferably be locked in a plurality of suitable positions relative to the housing part 120. The push button 150 is embodied with a corrugation in order to facilitate use (for example, see FIG. 3); this corrugation can be embodied in the form of rays of sunshine or petals of a flower. In lieu of the locking mechanism, the cosmetic container 100 can be provided with a hole in the middle, making it possible to produce a more reasonably priced variant with little effort.

Figure 6:
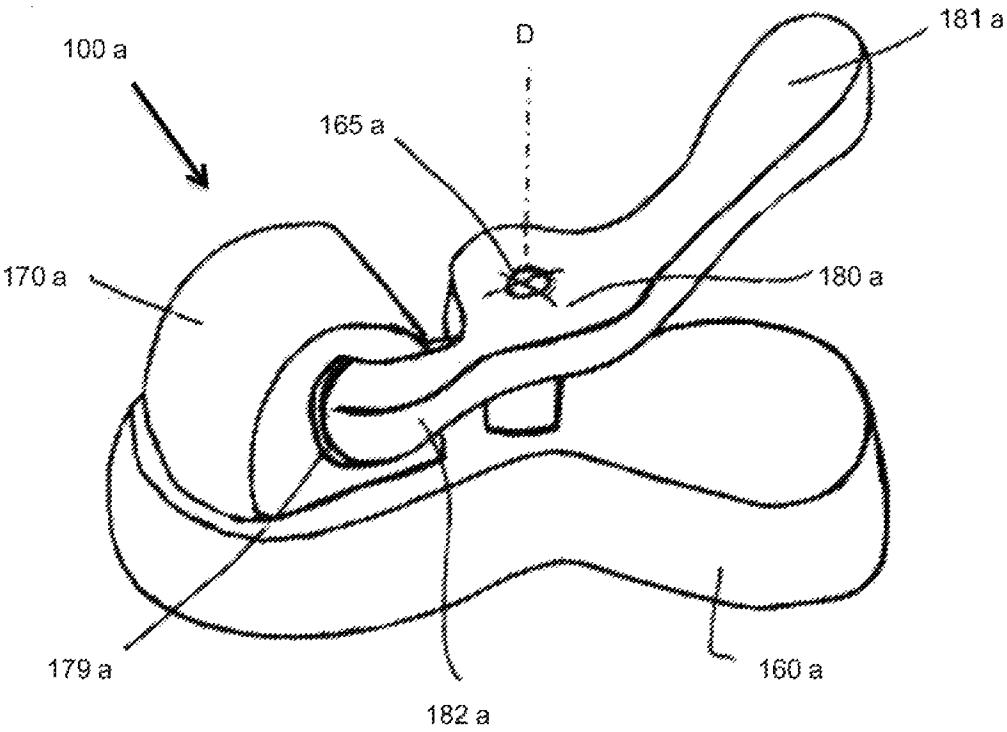
FIG. 6 shows a second exemplary embodiment of a cosmetic container with the applicator in the idle position.
Figure 7A:
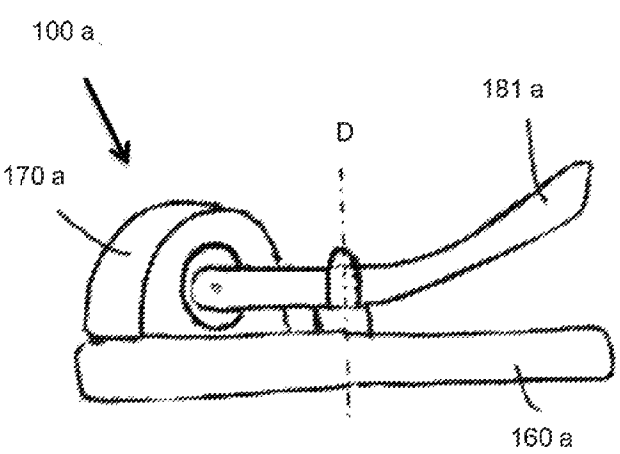
FIGS. 7A-7D show the cosmetic container from FIG. 6 in several individual views.
Figure 7B:
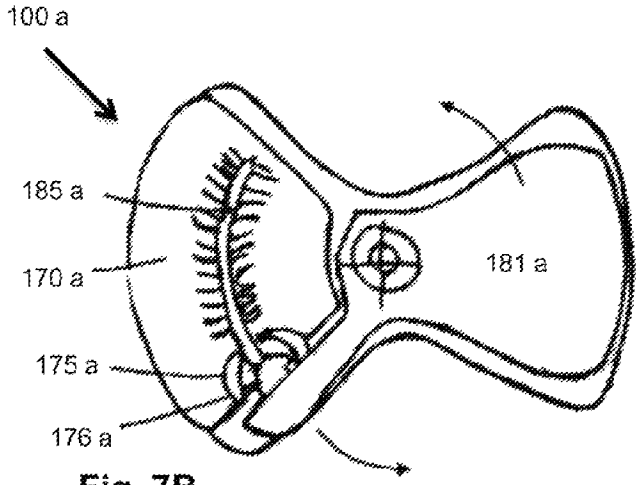
Figure 7C:
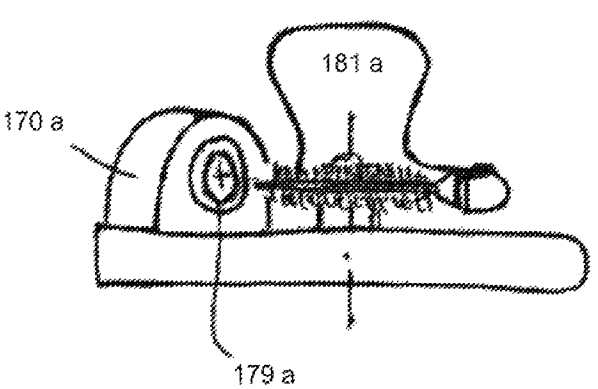
Figure 7D:
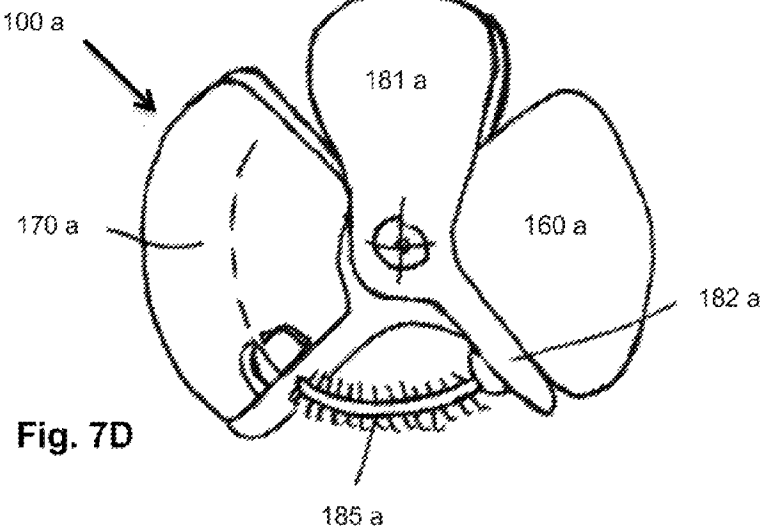

FIG. 6 shows a second exemplary embodiment. The cosmetic container, which is labeled as a whole with the reference numeral 100*a*, includes a base plate 160*a*, on which a reservoir 170*a* (for the cosmetic product) with a withdrawal opening 179*a* is situated. The reservoir 170*a* can be replaceable. The cosmetic container 100*a* also has a pivoting lever 180*a* with an actuating grip or actuating arm 181*a* and an applicator arm 182*a*. The pivoting lever 180*a* is fastened to the base plate 160*a* in pivoting fashion by means of the pivot joint 165*a*. The pivot joint 165*a* includes, for example, a journal or hinge pin situated on the base plate 160*a*, onto which the pivoting lever 180*a* is slid or clipped. The pivot axis is labeled with the letter D. The applicator arm 182*a* supports an applicator 185*a* (see FIG. 7). By pivoting the pivoting lever 180*a* (relative to the base plate 160*a*) around the pivot axis D, which is carried out by exerting a force on the actuating arm 181*a*, the applicator 185*a* can be pivoted between its idle position inside the reservoir 170*a* (see FIG. 7B) and at least one use position outside the reservoir 170*a* (see FIG. 7D), which is clearly shown by FIG. 7. FIGS. 7A and 7B show the applicator 185*a* in its idle position. FIGS. 7C and 7D show the applicator 185*a* in its use position. The reference numeral 175*a* identifies a sealing element and/or stripper element. The reference numeral 176*a* identifies a sealing cone and/or guide cone on the applicator arm 182*a*. The cosmetic container 100*a* can be equipped with detent elements, locking elements, and/or spring elements. In addition, the preceding explanations given in connection with the first exemplary embodiment also apply in analogous fashion here.

Figure 9:
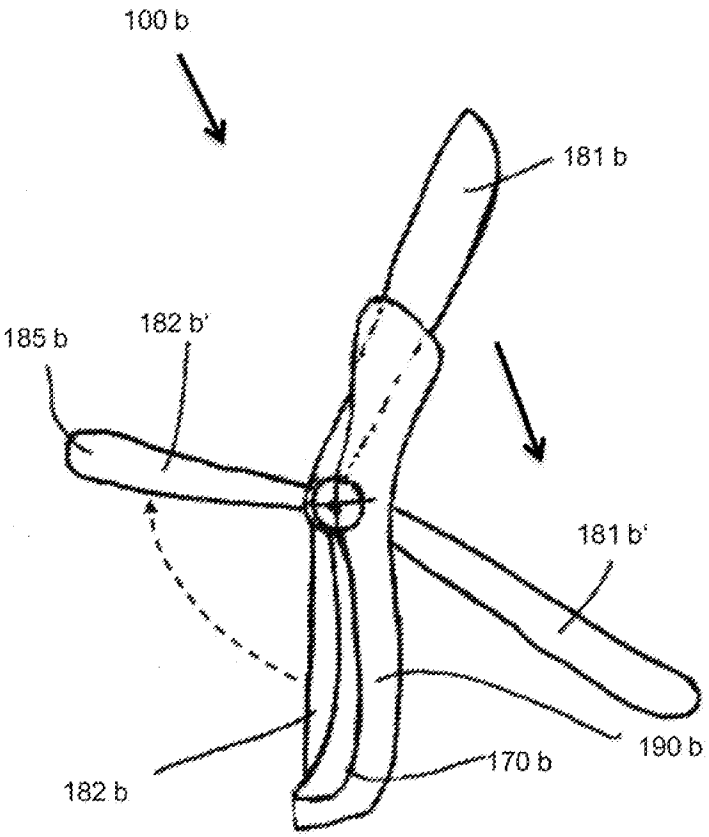
FIG. 9 shows the basic function of the cosmetic container from FIG. 8.
Figure 8:
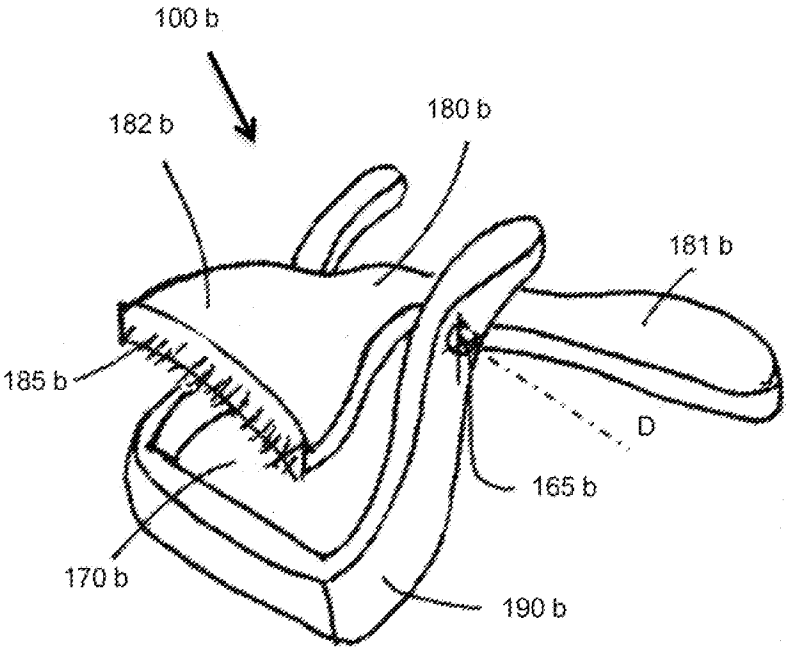
FIG. 8 shows a third exemplary embodiment of a cosmetic container, with the applicator in the use position.
Figure 10:
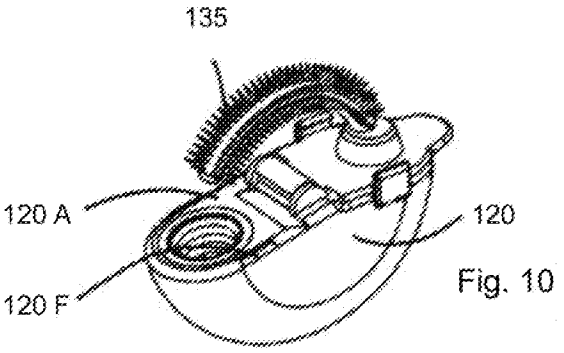
FIG. 10 is a side view of another, fourth exemplary embodiment in the open position, whose design essentially resembles that of the first exemplary embodiment.
Figure 11:
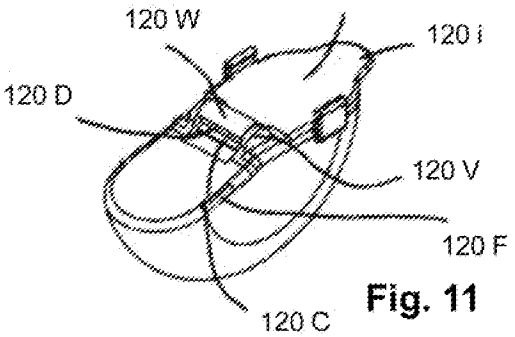
FIG. 11 is a perspective view of the fourth exemplary embodiment.

FIG. 8 shows a third exemplary embodiment. The cosmetic container, which is labeled as a whole with the reference numeral 100*b*, is embodied in the form of a clamp and includes two clamping levers 180*b* and 190*b*, which are connected to each other in pivoting fashion by means of a pivot joint 165*b*. The clamping lever 190*b* accommodates a cosmetic product reservoir 170*b* that can be closed by the applicator arm 182*b* of the clamping lever 180*b*. The actual filling chamber (reservoir) for the cosmetic product can be protected by means of a sieve or the like, through which the cosmetic product can travel to the applicator 185*b*. The clamping lever 190*b* is embodied in the form of a fork in order to permit an optimal pivotability of the second clamping lever 180*b*. An applicator 185*b* is situated on the applicator arm 182*b* of the clamping lever 180*b*. In order to pivot the clamping lever 180*b* (relative to the clamping lever 190*b*) around a pivoting axis D, the applicator 185*b* can be pivoted around the pivoting axis D between an idle position inside the reservoir 170*b* (in which it rests, for example, against the sieve and is able to load up with the cosmetic product through the sieve) and at least one use position outside the reservoir 170*b*, which is clearly shown in FIG. 9. The cosmetic container 100*b* can have detent engagement means, locking elements, and/or spring elements. In addition, the preceding explanations with regard to the first and second exemplary embodiments also apply.

In general, it should be noted that the features of the invention shown in the figures and/or explained below can be general features, independent of the feature combinations shown and/or described. Furthermore, in the context of the invention, the features shown in the figures and/or explained above can be combined to form other exemplary embodiments according to the invention.

FIGS. 10 through 14 show a fourth exemplary embodiment of the invention. The engineering of this exemplary embodiment is close to the engineering of the first exemplary embodiment, which is why all of the things that have been described above in conjunction with the first exemplary embodiment are also true of this present exemplary embodiment, provided that they are not left unused due to their different embodiment.

In this exemplary embodiment, the housing part 120 is essentially embodied in the form of a semicircle. Preferably, an angle DW of between 150° and 230° is enclosed between the two end surfaces 120A of the housing part. Preferably, a fixed axle 120D is embodied on the housing part 120. Ideally, this axle 120 D is embodied between the bearing pedestals 120V so that it has a circumference surface extending freely in space all the way around it and is attached to the bearing pedestals 120V at its ends. The housing part 120, the bearing pedestals 120V, and the axle 120D are ideally molded out of a single piece.

Figure 12:
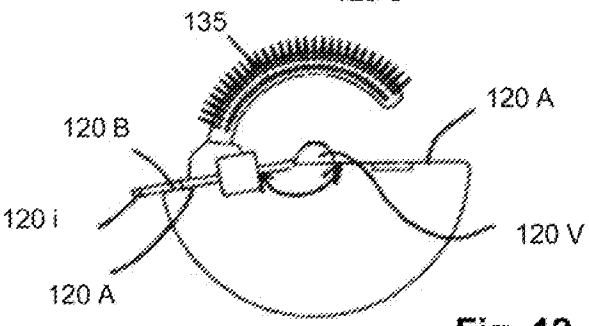
FIG. 12 shows the fourth exemplary embodiment in the closed position.
Figure 13:
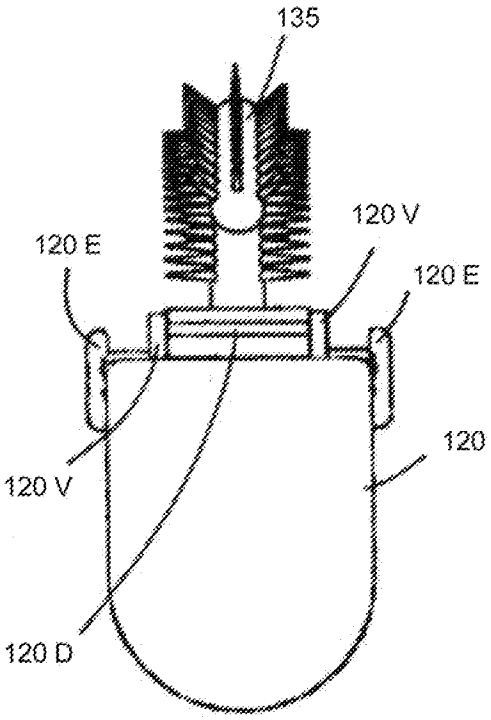
FIG. 13 shows the fourth exemplary embodiment, viewed from a narrow side.

The housing part 120 includes a folding cover 120B. This folding cover 120B supports the applicator 135, which is preferably embodied in the same way as has already been described in connection with the first exemplary embodiment. As is best shown in FIG. 12, the folding cover 120B is provided with an axle sleeve 120W that is preferably molded onto it. This axle sleeve 120W is a cylindrical profile that is slotted in the longitudinal direction. The slot 120C is embodied so that the axle sleeve 120W can be snapped onto the fixed axle 120D so that the folding cover 120B can be pivoted around the fixed axle 120D from an open position into a closed position with the assistance of its axle sleeve 120W.

The folding cover is provided with the means 120E that permit it to be immobilized in its completely closed position on the housing part 120 and preferably also in its completely open position. Preferably, the immobilizing action is provided by means of a form-locking engagement. As is clear from the Figs., the means 120E are preferably embodied in the form of form-locking elements molded directly onto the folding cover 120B, which are associated with corresponding detent engagement recesses 120F on the housing part 120 into which the above-mentioned form-locking element can be inserted.

Figure 14:
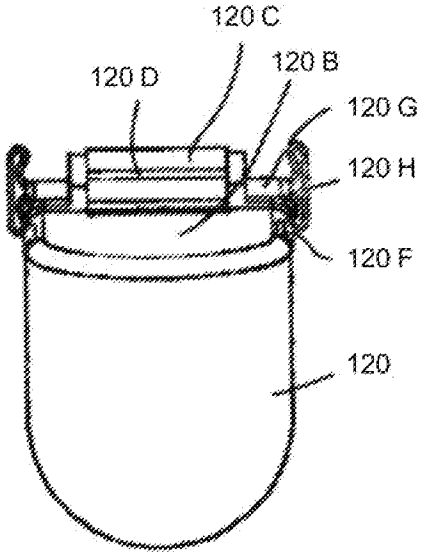
FIG. 14 shows the axle of the fourth exemplary embodiment.

FIG. 14 gives a detailed view of the form-locking elements. As is clear from the drawing, each of the form-locking elements has an essentially T-shaped cross-section. In this case, the part that can be referred to as the upright 120G of the T is embodied as flexible so that the crossbar 120H of the T is able to pivot back and forth a certain amount around the upright. In this way, the form-locking elements on the crossbar 120H of the T can be brought into or out of engagement with the detent elements associated with it.

Preferably, the folding cover 120B has a projection 120*i* with which it protrudes beyond the contour of the housing part 120 in the closed position so that the folding cover 120B can be conveniently folded open and closed again with the aid of the projection 120*i*.

The applicator used in this exemplary embodiment preferably is the same as all of the applicators in the context of this description—the applicator is an applicator with an injection molded core and bristles that are molded onto the latter and composed of the same plastic or of a different plastic.

Figure 15:
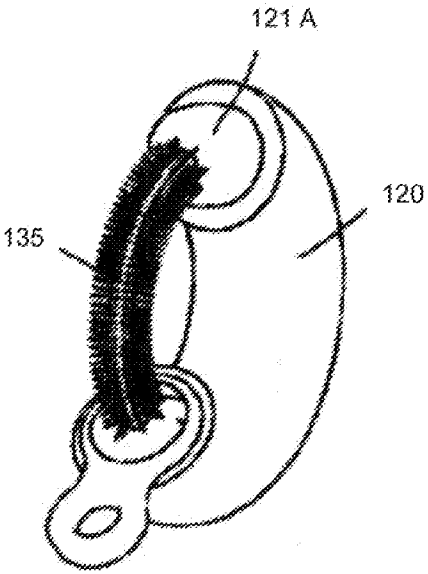
FIG. 15 shows a fifth exemplary embodiment at an oblique angle from the front, in the open position.
Figure 16:
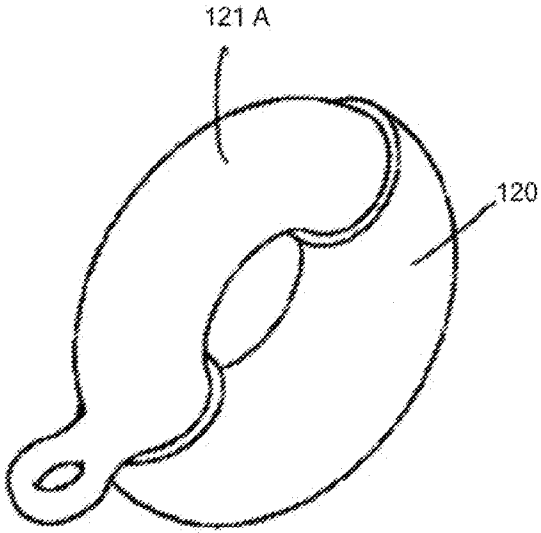
FIG. 16 shows a fifth exemplary embodiment at an oblique angle from the front, in the closed position.
Figure 17:
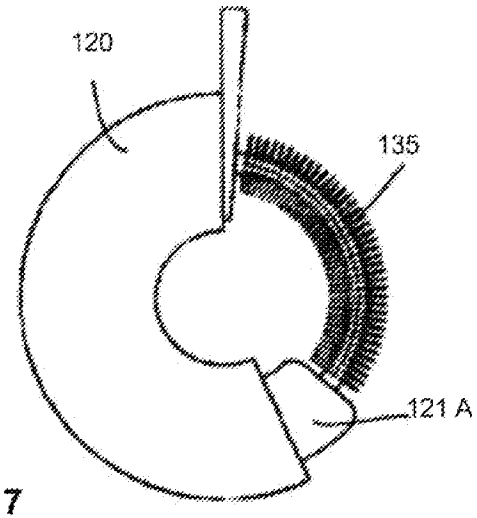
FIG. 17 shows a fifth exemplary embodiment from the side, in the open position.

FIGS. 15 through 17 show a fifth exemplary embodiment of the invention.

This exemplary embodiment of the invention features the fact that the housing 120 in this case is embodied in the form of a toroidal tube. The correspondingly embodied guide body 121A of the applicator (generally with a round cross section and embodied in the form of a segment of a circle) slides inside of this tube. Once again, the applicator is essentially embodied in the same way as described in the first exemplary embodiment. The housing part 120 and the guide body 121A of the applicator, which supports the actual applicator, are embodied so that in the completely open, application-ready state, the entire arrangement produces an intrinsically closed circular torus.

If the distal end of the applicator core is oriented away from the guide body 121A of the applicator in a corresponding fashion, then in this exemplary embodiment, it is possible to guide the distal end of the applicator core with the aid of the stripper, which is not visible in the drawing, so that the applicator core does not noticeably deform during use, as a result of which the applicator is perceived to be rigid and the user does not have the impression that the distal end of the applicator is being deflected during the application.

Here, too, the body of the applicator has a projection 120*i* with which it protrudes beyond the housing part 120, preferably in the radial direction. In this way, the applicator can be conveniently brought from its stowed position into its open position and vice versa, preferably with one finger.

In order to immobilize the applicator in its stowed position and in its open position, detent engagement means, which are not shown here, are preferably provided, which immobilize the guide body of the applicator in the corresponding position through form-locking engagement relative to the housing part 120 of the applicator.

The invention claimed is:

1. A cosmetic container for a liquid or paste-like cosmetic product or the like, comprising:

a reservoir for the cosmetic product; and an applicator for applying the cosmetic product to skin and/or hair, wherein the applicator is embodied in the form of an arc with a constant or essentially constant radius relative to a pivoting axis (D) and can be pivoted into and out of the reservoir through a withdrawal opening, and the applicator is supported on the cosmetic container in pivoting fashion and by pivoting around the pivoting axis (D), can be pivoted between an idle position inside the reservoir and at least one use position outside the reservoir.

2. The cosmetic container as recited in claim 1, wherein a sealing element is situated in the withdrawal opening of the reservoir.

3. The cosmetic container according to claim 1, wherein the applicator is equipped with a small sponge and/or a set of bristles.

4. The cosmetic container according to claim 1, wherein a pivoting angle (a) is between 50° and 150°.

5. The cosmetic container according to claim 1, wherein at least one stop device is provided for limiting the pivoting movement.

6. The cosmetic container according to claim 1, further comprising a detent engagement device, which temporarily immobilizes the applicator in the idle position and/or in the use position.

7. The cosmetic container according to claim 1, further comprising a locking mechanism, which prevents the applicator from being able to inadvertently be moved out of its idle position and/or use position.

8. The cosmetic container according to claim 1, wherein the cosmetic container is embodied as flat and round.

9. The cosmetic container as recited in claim 8, wherein end surfaces of the cosmetic container are embodied with concave recesses.

10. The cosmetic container as recited in claim 8, wherein the cosmetic container further comprises a housing part and an actuating grip that is supported in pivoting fashion on the housing pan and the applicator is affixed to the pivotable actuating grip.

11. The cosmetic container as recited in claim 10, wherein when being pivoted from a closed position into an open position, the pivotably supported actuating grip can travel into a cavity inside the cosmetic container.

12. The cosmetic container as recited in claim 8, wherein the cosmetic container is essentially composed of a metal material, an aluminum material, or of a plastic material.

13. The cosmetic container as recited in claim 8, wherein the cosmetic container has at least one eyelet into which a cord or chain can be threaded.

* * * * *